US008272072B1

(12) United States Patent
Fowler

(10) Patent No.: US 8,272,072 B1
(45) Date of Patent: Sep. 25, 2012

(54) SYSTEM FOR REVERSIBLE GARMENTS ABSENT SEWN SEAMS

(76) Inventor: Mary Lee Fowler, Staten Island, NY (US)

( * ) Notice: Subject to any disclaimer, the term of this patent is extended or adjusted under 35 U.S.C. 154(b) by 144 days.

(21) Appl. No.: 12/958,941

(22) Filed: Dec. 2, 2010

(51) Int. Cl.
*A41F 1/02* (2006.01)
*D05B 3/14* (2006.01)
*D05B 3/08* (2006.01)

(52) U.S. Cl. ..... 2/265; 2/69; 2/301; 2/263; 2/266

(58) Field of Classification Search ..... 2/1, 69, 2/74, 77, 79, 100, 119, 124, 301, 309–322, 2/263, 265, 266, 275
See application file for complete search history.

(56) References Cited

U.S. PATENT DOCUMENTS 1,445,119 A * 2/1923 White ..... 24/101 R
1,741,027 A * 12/1929 King ..... 24/114.11
1,938,510 A * 12/1933 Blechman ..... 2/46
2,017,750 A * 10/1935 Alexander ..... 2/74
2,077,772 A * 4/1937 Ring ..... 33/13
2,277,667 A * 3/1942 Rogers ..... 462/83
2,411,328 A * 11/1946 MacNab ..... 33/12
2,425,635 A 8/1947 Nitzberg
2,553,847 A * 5/1951 Collins ..... 33/12
2,556,039 A 6/1951 Landert
2,733,446 A * 2/1956 Macrides ..... 2/128
3,064,265 A 11/1962 Bridgewaters
3,116,491 A * 1/1964 Previdi et al. ..... 2/106
3,136,412 A * 6/1964 Karosen ..... 206/574
3,257,727 A * 6/1966 Berlin ..... 33/12
3,345,645 A * 10/1967 Di Addario ..... 2/115
3,699,617 A * 10/1972 Hofmeister ..... 24/341
3,720,982 A * 3/1973 Myers et al. ..... 24/104
3,877,078 A * 4/1975 Tepper ..... 2/74
3,879,808 A * 4/1975 Alberts ..... 24/109
4,104,742 A 8/1978 Rahaim
4,156,969 A * 6/1979 Werber ..... 33/14
4,242,776 A * 1/1981 Kurashima ..... 24/102 SL
4,333,182 A * 6/1982 Seibt ..... 2/265
4,631,765 A * 12/1986 Casey ..... 5/417
4,646,666 A * 3/1987 Burrier ..... 112/475.22
4,682,389 A * 7/1987 Callender ..... 24/601.7
4,907,320 A * 3/1990 Miao ..... 24/101 R
5,038,413 A * 8/1991 Ursino ..... 2/239
5,412,848 A * 5/1995 Precourt, Jr. ..... 24/99
5,416,928 A 5/1995 Koenig
5,671,507 A * 9/1997 Deschenes et al. ..... 24/114.7
5,740,558 A * 4/1998 Messman ..... 2/239
5,894,600 A * 4/1999 Chenefront ..... 2/69
5,919,334 A * 7/1999 Niedermeyer ..... 156/479
5,970,541 A * 10/1999 Chiang ..... 5/420
6,032,287 A 3/2000 Kallas (Continued)

*Primary Examiner* — Bobby Muromoto, Jr.
(74) *Attorney, Agent, or Firm* — Goldstein Law Offices, P.C.

(57) ABSTRACT

A reversible, seamless article of clothing and a system for constructing reversible seamless garments and accessories by assembling and attaching a plurality of reversible and interchangeable panels of the article of clothing with a plurality of fasteners. The panel elements have a plurality of edges with a plurality of buttonholes adjacent to the edges. The fasteners are elastomeric two-headed button studs. The panel elements are attached by matching the buttonholes of the elements to form the article of clothing and inserting the studs into the buttonholes to fasten the panel elements. A plurality of trim elements have buttonholes adjacent to the edges and can be attached to the article of clothing by inserting the stud into a trim buttonhole and a buttonhole on the garment. With the system of construction using reversible elements with buttonholes and stud fasteners, accessories, such as tote bags and watch bracelets, can be constructed.

10 Claims, 5 Drawing Sheets

U.S. PATENT DOCUMENTS

| | | | | |
|---|---|---|---|---|
| 6,182,296 | B1 * | 2/2001 | Hosogai | 2/227 |
| 6,412,153 | B1 * | 7/2002 | Khachadourian et al. | 24/614 |
| 6,568,044 | B1 * | 5/2003 | Kidd | 24/104 |
| 7,302,712 | B2 * | 12/2007 | Abrusia et al. | 2/239 |
| 7,409,726 | B2 * | 8/2008 | Bahm et al. | 2/49.1 |
| 7,748,058 | B2 | 7/2010 | Steitle | |
| 2002/0194676 | A1 * | 12/2002 | Yang | 5/482 |
| 2003/0106194 | A1 * | 6/2003 | Lo | 24/662 |
| 2004/0227752 | A1 * | 11/2004 | McCartha et al. | 345/419 |
| 2005/0198868 | A1 * | 9/2005 | Scholz | 36/67 D |
| 2006/0048262 | A1 * | 3/2006 | Sencion | 2/69 |
| 2006/0053661 | A1 * | 3/2006 | van Duyne | 36/100 |
| 2006/0137075 | A1 | 6/2006 | Gheneva | |
| 2007/0152007 | A1 * | 7/2007 | Kauss et al. | 224/637 |
| 2007/0279852 | A1 * | 12/2007 | Daniel et al. | 361/683 |
| 2008/0249652 | A1 * | 10/2008 | Burr | 700/132 |
| 2008/0289105 | A1 * | 11/2008 | Ranzau | 5/482 |
| 2009/0235434 | A1 * | 9/2009 | Ratcliffe | 2/269 |
| 2010/0132089 | A1 * | 6/2010 | Myers | 2/79 |
| 2010/0162863 | A1 * | 7/2010 | Johnson | 83/23 |
| 2011/0061207 | A1 * | 3/2011 | Forbes | 24/104 |
| 2011/0148921 | A1 * | 6/2011 | Ko | 345/630 |

* cited by examiner

SYSTEM FOR REVERSIBLE GARMENTS ABSENT SEWN SEAMS

BACKGROUND OF THE INVENTION

The invention relates generally to a reversible, seamless article of clothing and a system for constructing reversible seamless garments and accessories. When this disclosure refers to 'seams', the disclosure is referring to sewn or stitched seams. More particularly, the invention relates to a reversible, seamless article of clothing and a system for constructing reversible seamless garments and accessories by assembling and attaching a plurality of reversible and interchangeable elements of the article of clothing with a plurality of button stud fasteners.

Basic garment construction is an ancient domestic skill passed from one generation to the next. Although today most people wear clothing that is massed produced in factories, many people enjoy wearing handmade clothing from cloth selected especially for them and constructed in an individualized style. Many parents, particularly mothers, teach their child the basics of clothing construction once the child is old enough to have the fine motor skills to handle a sharp needle and razor-edged scissors safely and effectively.

Young children enjoy making their own clothing choices. Being able to select what he or she will wear teaches a child decision-making skills as well as understanding what type of clothing is appropriate to wear in a particular situation. Children enjoy having reversible clothing, that is clothing that does not have a "wrong" side, but has two "right" face sides that can be worn with either side showing. Reversible clothing effortlessly doubles the options a child has in selecting what to wear. Young children can only select clothes from garments in their closet and cannot construct new clothes on their own because they do not have the necessary sewing and scissor skills to do so.

Basic garment construction consists of cutting and assembling different panels of cloth and attaching the panels to each other by sewing the edges of the panels together to form seams. Edges are sometimes left unattached to form a placket where the two panels of the garment are attached by fasteners such as buttons, snaps, zippers, hook and eye fasteners or hook and loop material and not by seams. Although there is not necessarily a seam to form the placket, sewing is required to attaching the various fasteners, such as buttons, zippers, hooks and so on.

Many have proposed different methods to provide variations to a basic article of clothing that do not require sewing. Several have proposed front panels that button to the front, top or bottom of a previously constructed sewn garment that has buttons aligned with the buttonholes of the panel, or snaps or hook and loop material that aligns with snaps or hook and loop material on the panel. The panels extend the length of the garment, adjust the size of the garment, add a feature such as a collar or cuffs or merely change the appearance. In one example, the panel is a bib that can be changed when soiled. In some examples, the panel or additional piece is reversible, with either side of the element appropriate for the outside of the garment.

All the examples are for adding additional elements to vary a basic garment or accessories without sewing. None provide a method for constructing a basic garment or accessory without sewing and none provide a method of fastening that does not require sewing or permanently affixing fasteners onto the basic garment.

While these units may be suitable for the particular purpose employed, or for general use, they would not be as suitable for the purposes of the present invention as disclosed hereafter.

SUMMARY OF THE INVENTION

It is an object of the invention to produce a system of garment construction that allows a child to assemble an article of clothing herself. Accordingly, the system of garment construction requires no sewing so that a child can assemble an article of clothing herself.

It is another object of the invention to produce a system of garment construction that allows a child to vary how an article of clothing appears. Accordingly, the system of garment construction using reversible elements to construct an article of clothing that allows a child to chose a side of the garment element to display when assembling the garment.

It is a further object of the invention to produce a system of garment construction that allows a child to use fasteners that do not require sewing to an article of clothing. Accordingly, the system of garment construction uses a two-headed button head stud that allows a child to fix one element of the article of clothing to the other with the two-headed button stud by inserting the stud into a buttonhole on a first element and a buttonhole on a second element to attach the two elements.

It is yet a further object of the invention to produce a system of garment construct that allows a child many different variations of how an article of clothing appears. According, the system of garment construction has a plurality of reversible panel elements, a bodice having four panels and a skirt having four panels, that allows a child to create an exponential number of variations by reversing and swapping panels.

It is yet another object of the invention to produce a system of garment construction that allows a child to attach a plurality of elements of an article of clothing together without sewing. Accordingly, the system of garment construction has a plurality of studs and a plurality of elements with a plurality of buttonholes that allows a child to attach a first element to a second element by matching the buttonholes of the elements and inserting the studs into the buttonholes on the first element and the buttonholes matched with the first element on the second element to attach the two elements to each other.

It is still a further object of the invention to produce a system of garment construction that allows a child to trim an article of clothing without sewing. Accordingly, the system of garment construction has a plurality of trim elements with a plurality of buttonholes that allows a child to attach a trim, such as a pocket or a trim strip, to panels of the article of clothing by matching the buttonholes of the trim with the buttonholes of the panels and inserting the studs into the matched buttonholes to attach the trim to the panels without sewing.

The invention is a reversible, seamless article of clothing and a system for constructing reversible seamless garments and accessories by assembling and attaching a plurality of reversible and interchangeable panel elements of the article of clothing with a plurality of fasteners. The panel elements have a plurality of edges with a plurality of buttonholes adjacent to the edges. The fasteners are elastomeric two-headed button studs. The panel elements are attached by matching the buttonholes of the elements to form the article of clothing and inserting the studs into the buttonholes to fasten the panel elements. A plurality of trim elements similarly have buttonholes adjacent to the edges and can be attached to the article of clothing by inserting the stud into a trim buttonhole and a buttonhole on the article of clothing. Using the system of construction using reversible elements with buttonholes and stud fasteners, accessories, such as tote bags and watch bracelets, can be constructed.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 4:
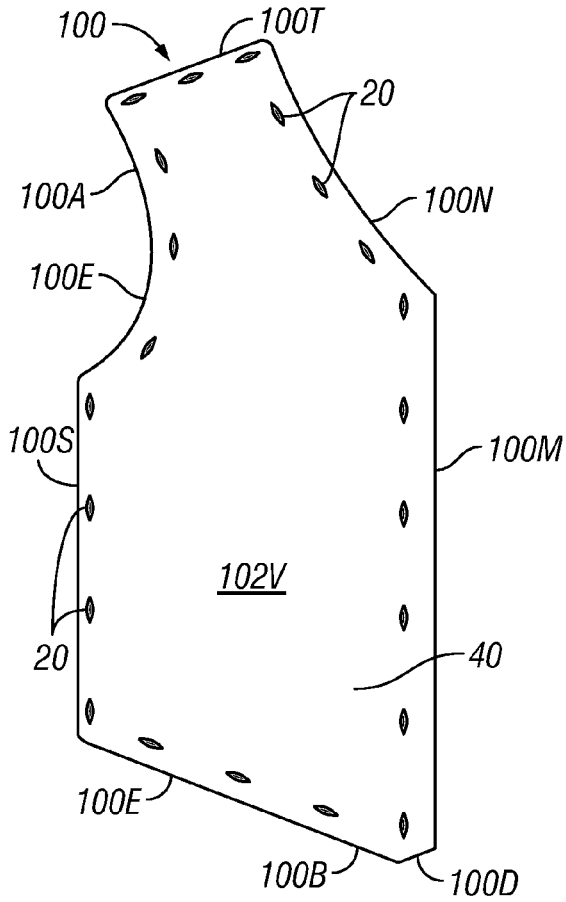
FIG. 4 is a front elevation view of a bodice panel of the reversible seamless article of clothing.

FIG. 4 illustrates a bodice panel 100 in an obverse view for use in a seamless garment construction system. The seamless garment construction system has three essential elements and a plurality of trim elements and accessory elements. The panel 100 is a first element of the three essential elements of the seamless garment construction system. When joined with three additional bodice panels, a user can assemble a bodice. The bodice panel 100 is reversible, having two outer surfaces 100S, each having a fabric face side, the panel formed by a pair of fabric layers 40, attached together so that the face sides of the fabric layers 40 are on the outer surfaces 100S of the panel. The bodice panel 100 has a plurality of edges 100E. To assemble the bodice, four panels are laid out attached at the edges 100E as described hereinbelow. Disposed along and adjacent to the edges is a plurality of buttonholes 20 approximately 25 to 50 millimeters (mm) apart. The plurality of buttonholes adjacent to the edges are a second essential element. The edges 100E of the panels are attached by placing a plurality of two-headed button studs 30, one each in a buttonhole 20 to join the panels. The buttonholes 20 on the edges 100E receive the studs 30 to fasten the panels 100 together, replacing the plurality of seams fastening the panels together in the traditional garment construction system.

Figure 3:
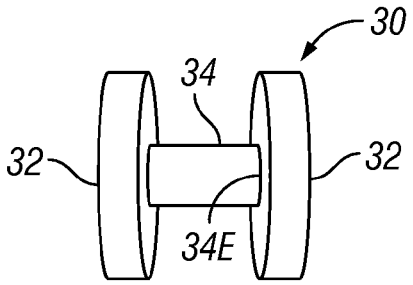
FIG. 3 is a diagrammatic perspective side view of a two-headed button stud for attaching panels in a reversible, seamless garment system.

FIG. 3 shows a two-headed button stud 30 for use as a nonpermanent fastener in the seamless garment construction system. The nonpermanent fastener 30 is a third essential element of the seamless garment construction system. The stud has a shaft 34 approximately 8 mm in length, having a pair of ends 34E and a pair of button heads 32 approximately 15 mm in diameter, each attached orthogonally to opposite ends, a head to each end 34E of the shaft 34. The studs 30 are flexible, made from an elastomeric material such as, for example, rubber. The button heads 32 can be embossed to add an additional design element to an article of clothing.

The bodice panel 100 is uniquely shaped so that the panel 100 is useful as any one of the four panels of the bodice, by using either the obverse or inverse views. In FIG. 4 demonstrates the unique shape with the bodice panel 100 in the obverse view. In the obverse view, the bodice panel, having a length, has a bottom diagonal edge 100B, diagonally sloping downward toward the right, a top shoulder edge 100T, a right side medial edge 100M, extending upwardly about three-quarters of the length of the member from the bottom diagonal edge 100B, a neckline edge 100N extending downwardly toward the right, diagonally connecting the shoulder edge 100T and the medial edge 100M, a left side edge 100S extending upwardly about two-thirds of the length of the panel, a left side concave armhole edge 100A connecting the side edge 100S and the shoulder edge 100T. Where the medial edge 100M meets the bottom diagonal edge 100B, a small oblique edge 100D is formed sloping upwardly from the bottom diagonal edge 100B towards the medial edge 100M at an obtuse angle.

Each bodice panel 100 has an obverse side, forming an obverse member 102V and a reversed mirror image, an inverse side forming an inverse member, having a bottom diagonal edge, diagonally sloping downward toward the left, a top shoulder edge, a left side medial edge, extending upwardly about three-quarters of the length of the panel from the bottom diagonal edge, a neckline edge extending downwardly toward the left, diagonally connecting the shoulder edge and the medial edge, a right side edge extending upwardly about two-thirds of the length of the member, a right side concave armhole edge connecting the side edge and the shoulder edge. A small oblique edge slopes upwardly from the bottom diagonal edge towards the medial edge at an obtuse angle.

Figure 2:
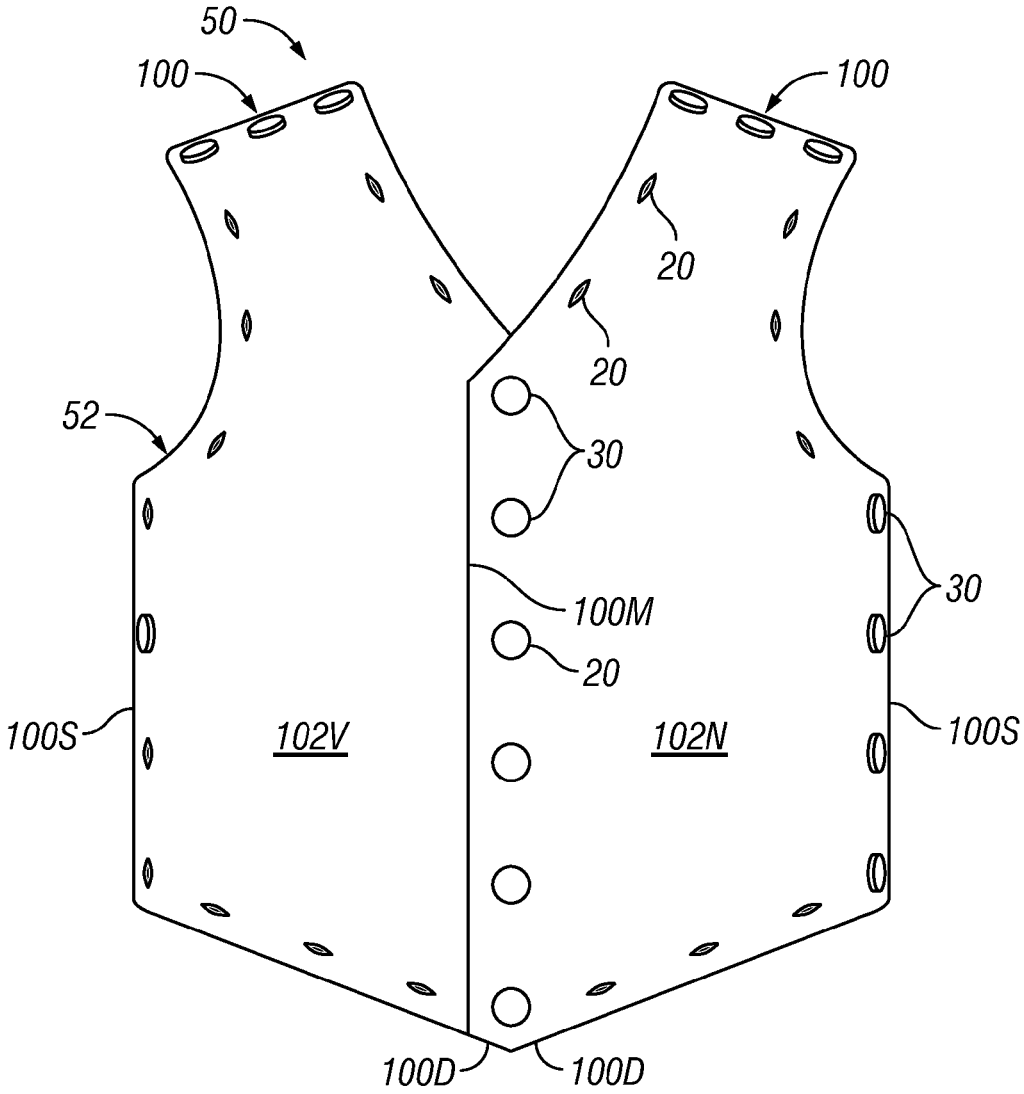
FIG. 2 is a front elevation view of a reversible seamless bodice constructed from a plurality of bodice panels.
Figure 16:
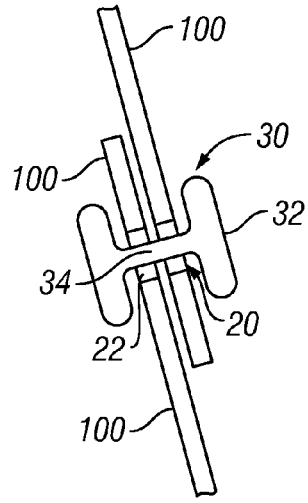
FIG. 16 is a side elevational view in cross-section of a junction where a pair of panels are attached by the two-headed button stud.

FIG. 2 shows how to form a sleeveless bodice 50 with the bodice panels 100. A user takes four bodice panels 100, two laid out as obverse members 102V and two laid out reversed in mirror image as inverse members 102N. Using the studs 30, the user attaches the medial edge 100M of the observe member 102V to the medial edge 100M of the inverse member 102N by overlapping the medial edges 100M, matching the buttonholes 20 adjacent to the edges 100M, forming a plurality of buttonhole pairs and placing one stud 30 in each buttonhole pair 20. There is a pair of short oblique edges 100D at the bottom of the medial edges 100M of the bodice. The unique oblique edges allow the panels to overlap to form a smooth bottom edge contour for the bodice. FIG. 16 shows the stud 30 in the buttonhole 20, the buttonhole having a thru bore 22, the stem 34 of the stud 30 passing through the bore 22 and connecting a first button head 32 on a side of a first attached panel 100 to a second button head 32 on a side opposite the first attached panel on a side of a second attached panel, holding the two panels together.

The user continues to form the bodice by taking and attaching the medial edge 100M of a second obverse member to the medial edge of the second inverse member in the manner described hereinabove. The user now has a pair of identical half portions 52, each having the obverse member 102V attached medially to the inverse member 102N. The user attaches the side edges 100S and the shoulder edges 100T of a first half portion 52 to the side edges 100T and shoulder edges 100T of a second half portion 52, forming the sleeveless bodice 50. When the fabric on the obverse side is identical to the inverse side, or if the obverse sides of the four pieces are identical but different from the inverse sides, the inverse sides being identical, only one variation is possible. If the obverse sides and the inverse sides are all different, the number of possible variations increases exponentially to a maximum of sixteen possible variations, allowing a child to pick panels and customize the bodice on every occasion.

Figure 5:
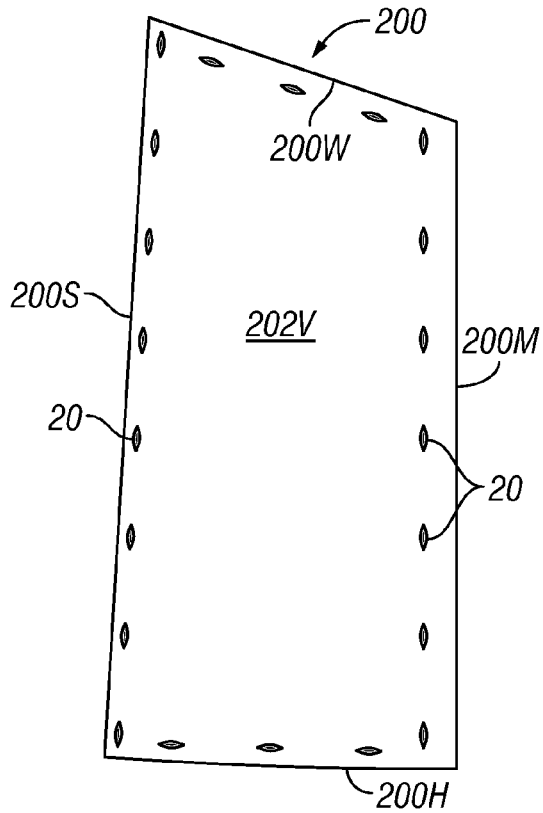
FIG. 5 is a front elevation view of a skirt panel of the reversible seamless article of clothing.

The user can use the system of seamless garment construction to produce a skirt. The dress uses a skirt panel 200 shown in FIG. 5. The skirt panel 200 is reversible in the same manner as the bodice panel as described hereinabove. Each skirt panel 200 has an obverse side, forming an obverse member 202V and a reversed mirror image, an inverse side forming an inverse member. The skirt panel 200 is uniquely shaped to join to the bottom edges of the bodice. The skirt panel 200, having a plurality of straight edges, in the obverse view, has a shorter right side medial edge 200M, a longer left side edge 200S, a bottom horizontal hem edge 200H and a top waistline edge 200W, diagonally sloping downward to the right. In the inverse view, the skirt panel member has a shorter left side medial edge, a longer right side edge, a bottom horizontal hem edge and a top waistline edge, diagonally sloping downward to the left. Adjacent to all edges are the plurality of buttonholes 20, approximately 25 mm to 50 mm apart.

To form the skirt 60, a user takes four skirt panels 200, two laid out as obverse members 202V and two laid out in reverse as inverse members. Using the studs, the user attaches the medial edge 200M of the observe member to the medial edge 2000M of the inverse member by overlapping the medial edges, matching the buttonholes adjacent to the edges, forming a plurality of buttonhole pairs and placing one stud in each buttonhole pair. The user continues to form the article of clothing following the steps described hereinabove for forming the sleeveless bodice.

Figure 1A:
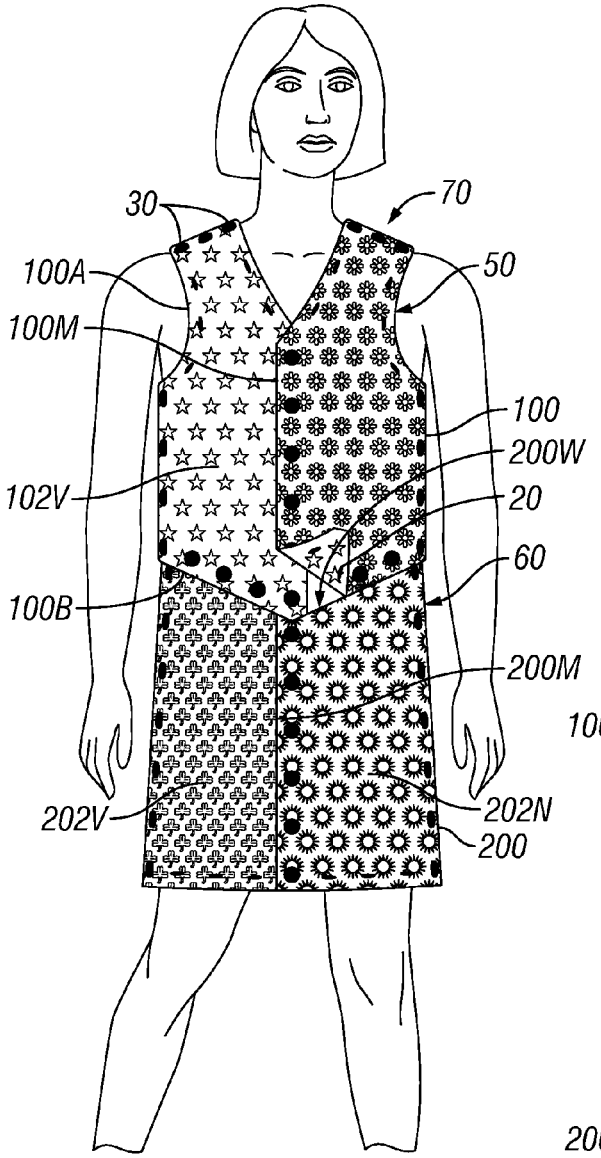
FIG. 1A is a front elevational view of a child wearing a reversible seamless garment.
Figure 1B:
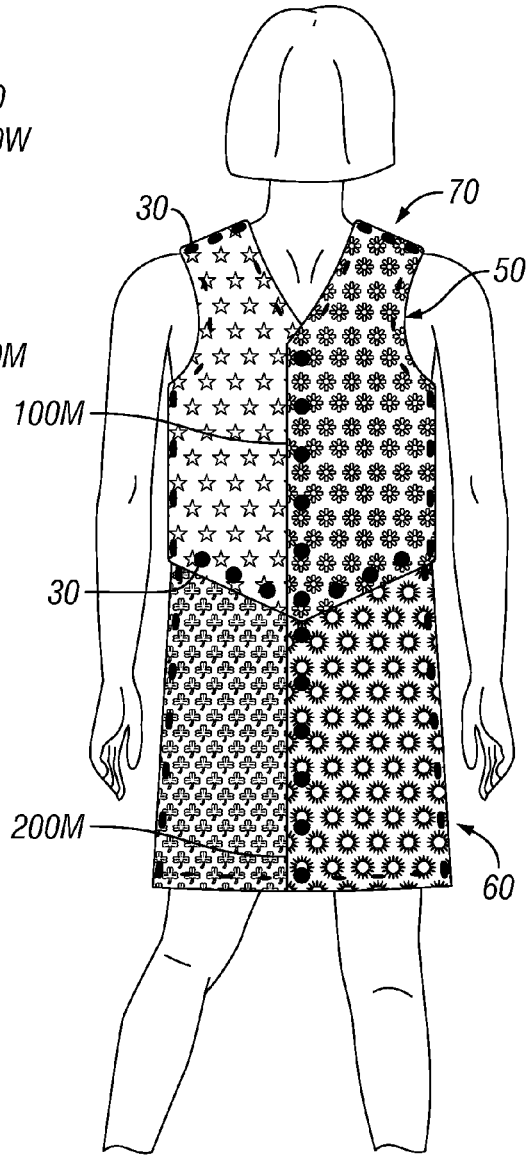
FIG. 1B is a back elevational view of the child wearing the reversible seamless garment.

The user can use the system of seamless garment construction to produce a dress 70. FIG. 1A and FIG. 1B show the basic dress 70 constructed from the three essential elements, the bodice panel, the skirt panel and button studs. The dress 70 uses the sleeveless bodice 50 and skirt 60 described hereinabove, attaching the bodice 50 and skirt 60 together in the manner described hereinbelow. As shown in FIGS. 1A and 1B, to attach the skirt 60 to the sleeveless bodice 50, the user aligns the skirt 60 with the bodice 50 by aligning the joined medial edges 100M and joined side edges 100S of the bodice 50 with the joined medial edges 200M and joined side edges 200S of the skirt 60, forming a plurality of continuous vertical straight lines. The user matches the buttonholes on the waist edge 200W of the skirt 60 with the bottom diagonal edge 100B of the bodice 50. When the buttonholes 20 are matched, forming a plurality of buttonhole pairs, studs 30 are received in the buttonhole pairs 20 to attach the bodice and skirt.

In FIG. 1A, the bottom edge 100B of the bodice 50 is shown in a turned up position to show the reversible side of the inverse member 102N, showing the obverse member 102V pattern. In this example, the four bodice panels 100 and the four skirt panels 200 have a first fabric layer with a pattern on the obverse member 102V, 202V and a second fabric with a second pattern on the inverse member 102N, 202N, demonstrating the relationship of the various members.

It is understood by those of ordinary skill, that the skirt and bodice can be worn separately. It is also understood by those of ordinary skill that a plurality of reversible leg panel members may be substituted for the skirt panel to form a jumpsuit.

Figure 9:
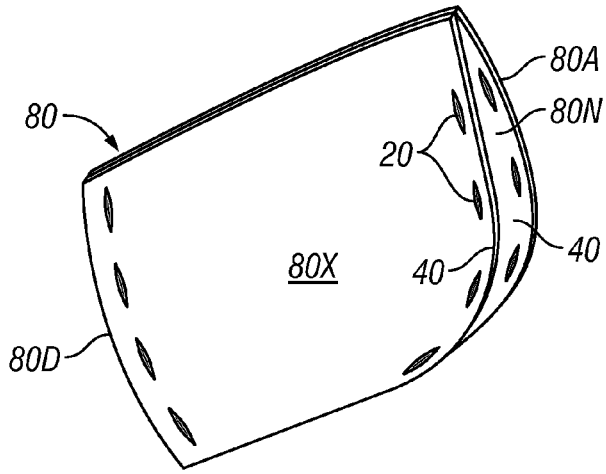
FIG. 9 is a diagrammatic perspective front view of a sleeve of the reversible seamless article of clothing.

FIG. 1A and FIG. 1B show the basic dress 70 constructed from the three essential elements, the panels, the buttonholes and button studs and the dress can be further modified with additional trim elements. Having formed the basic dress 70 without sewing seams, the user can attach other elements to modify the appearance of the article of clothing without sewing. A pair of sleeves 80 can be attached to the armholes edges 100A of the bodice panels 100. A sleeve element 80 as illustrated in FIG. 9, is a hollow cylinder, with an inside surface 80N and an outside surface 80X, having an outer distal hem edge 80D and a proximal armhole edge 80A, the edges having a plurality of buttonholes 20. The sleeve element 80 is reversible, having a first fabric layer 40 with a first pattern and a second fabric layer with a second pattern attached together so that the face sides of the fabric layers 40 are on both the inside surface 80N and the outside surface 80X of the sleeve. To reverse, the user turns the sleeve 80 inside out before attaching to the article of clothing. To attach the sleeve 80, the user matches the buttonholes of the armhole edge of the sleeve with the buttonholes of the armhole edge of the bodice, forming a plurality of buttonhole pairs and inserts the studs into the buttonhole pairs to secure the sleeve to the bodice armhole edge.

Figure 6:
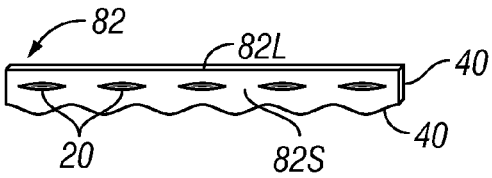
FIG. 6 is a diagrammatic perspective front view of a lace trim strip of the reversible seamless article of clothing.

FIG. 6 shows a horizontal trim strip element 82, having a pair of long edges 82L, a pair of surfaces 82S facing in opposite directions, and a plurality of buttonholes 20 horizontally disposed between the long edges 82L. The trim strip element 82 is reversible, having a first fabric layer 40 with a first pattern and a second fabric layer with a second pattern attached together so that the face sides of the fabric layers 40 are on the outer surfaces of the trim strip. The trim strip 82 can be added to the bottom edge of bodice by matching the buttonholes of the bottom edge of the bodice, with the buttonholes of the trim strip 82 forming a plurality of buttonhole sets. Even when the bottom edge of the bodice is attached to the waist edge of the skirt, the trim strip 82 can be added by receiving the studs holding the bodice and skirt together into the buttonholes 20 of the trim strip 82. The trim strip can be added to the hem edge of the sleeve or the hem edge of the skirt, selectively displaying one of the two fabric layers 40. The long edges 82L may be straight, or trimmed in an ornamental fashion, such as, for example, but not limited to, by cutting into scalloping or adding lace.

The user can add a triangular-shape neck trim element (which is not illustrated) to one or both half portions of the bodice to alter the appearance of a neckline. The neck trim element is an isosceles triangle, the base side having a variety of trim, a pair of equal sides have a plurality of buttonholes adjacent to the edge and a pair of outer surfaces facing in opposite directions. The neck trim element is reversible, having a first fabric layer with a first pattern and a second fabric layer with a second pattern attached together so that the face sides of the fabric layers are on the outer surfaces of the neck element. The buttonholes of the neck element are matched with the neckline edges of the two bodice panel members forming the bodice portion and attached by inserting studs through the buttonholes. The base side of the neck element may be straight or curved to form a jewel neckline or a polo neckline.

Figure 12:
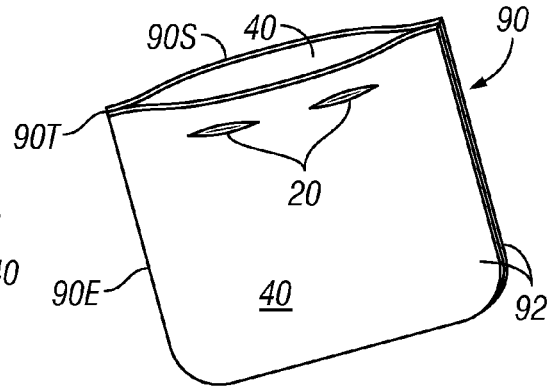
FIG. 12 is a diagrammatic perspective back view of a pocket of the reversible seamless garment.

The user can add a pocket 90, illustrated in FIG. 12. The pocket 90, having a top 90T, is formed by attaching a pair of reversible essentially rectangular panels 92, each having a pair of outer surfaces facing in opposite directions, creating an inside surface and an outside surface when joined. The pocket is reversible, each panel 92 having a first fabric layer 40 with a first pattern and a second fabric layer 40 with a second pattern attached together so that the face sides of the fabric layers are on the outer surfaces, facing in opposite directions. The user turns the pocket inside out to switch to different patterns. The rectangular panels each have four edges 90E, and the pocket is formed by joining three edges 90E, leaving a fourth open top edge 90S. The pocket 90 has a plurality of buttonholes 20 adjacent to the open edge 90S at the top 90T. The user chooses which surface of which panel 92 to display and matches the buttonholes 20 of the remaining panel at the top 90T of the pocket 90 with the buttonholes on the bottom edge of the bodice, and places the studs through the buttonholes on the remaining panel to attach the pocket. Even when the bottom edge of the bodice is attached to the waist edge of the skirt, the pocket 90 can be added by receiving the studs holding the bodice and skirt together into the buttonholes 20 of the pocket 90. To close the pocket 90, the user selectively inserts the studs holding the pocket 90 on the article of clothing in the buttonholes on the panel 92 that is displayed.

Figure 11:
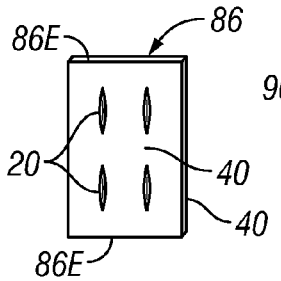
FIG. 11 is a diagrammatic perspective front view of a shoulder extender of the reversible seamless garment.

The user can lengthen the bodice by attaching a shoulder extender 86 to the shoulder edges of the bodice panels. The shoulder extender 86 as illustrated in FIG. 11, is a rectangular panel with a pair of short edges 86E having a pair of rows of buttonholes 20 disposed between the short edges 86E. The shoulder extender 86 has a first fabric layer 40 with a first pattern and a second fabric layer with a second pattern attached together so that the face sides of the fabric layers 40 are on outer surfaces of the shoulder extender 86. A first row of buttonholes 20 is matched with the buttonholes on the first shoulder edge 86E of the bodice panel on the first half portion and a second row is matched with the buttonholes 20 on the first shoulder edge of the bodice panel on the second half portion. The shoulder extender 86 is attached by inserting the studs into the matched buttonholes of the bodice panel and the shoulder extender 86. A second shoulder extender is attached to the second shoulder edges on the half portions in the manner described hereinabove.

Figure 10:
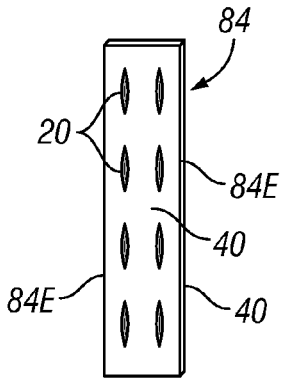
FIG. 10 is a diagrammatic perspective front view of an extender element of the reversible seamless garment.

Analogously, the user can widen the bodice and the skirt by attaching an extender 84 to the side edges of the bodice panels and skirt panels. As shown in FIG. 10, the extender panel is a reversible rectangle with a pair of long edges having a pair of rows of buttonholes 20 disposed along the long edges. The extender 84 has a first fabric layer 40 with a first pattern and a second fabric layer 40 with a second pattern attached together so that the face sides of the fabric layers 40 are on the outer surfaces of the extender 84. A first row of buttonholes 20 of the extender 84 is matched with the buttonholes on the first side edge of the bodice panel on the first half portion and a second row of buttonholes of the extender 86 is matched with the buttonholes on the first side edge of the bodice panel on the second half portion. The extender 84 is attached by inserting the studs into the matched buttonholes. A second extender is attached to the second side edges on the half portions in the manner described hereinabove.

Figure 8:
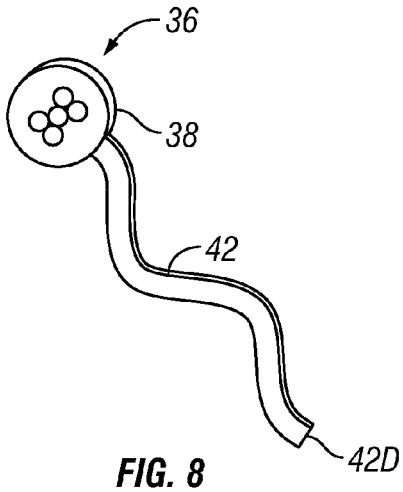
FIG. 8 is a diagrammatic perspective front view of a button ribbon for attaching elements in the reversible seamless garment system.

In one embodiment, the user can selectively use a beribboned button 36 as a nonpermanent fastener instead of a plurality of studs to attach the article of clothing elements and panels, particularly the medial edges of the of the bodice to add a decorative touch. The beribboned button 36, as illustrated in FIG. 8, is a large single button 38 attached to a length of ribbon 42 with a distal end 42D opposite the button 38. The user threads the distal end 42D through the first matched buttonhole pair, pulling the ribbon 42 through until the button 38 abuts the buttonhole. The ribbon 42 is inside the article of clothing and the user threads the ribbon 42 through the adjacent buttonhole, moving the ribbon 42 outside the article of clothing, and continues alternatively threading the ribbon inside and outside until the distal end 42D of the ribbon 42 is not sufficiently long to thread through another buttonhole. The user optionally knots the distal end 42D to keep the beribboned button 36 in place attaching the edges of the panels.

Figure 15:
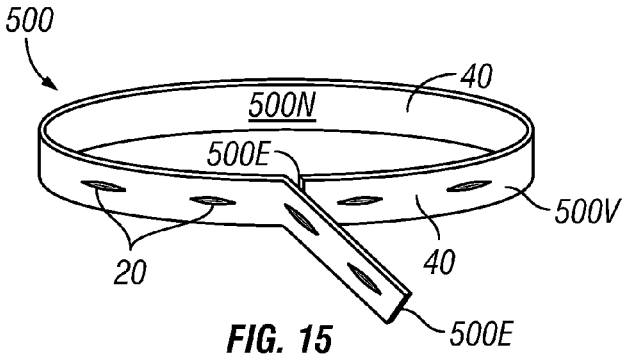
FIG. 15 is a diagrammatic perspective front view of a belt, an accessory constructed using the reversible seamless garment system.

FIG. 15 shows a reversible belt 500, an example of many items possible using the seamless garment construction system for coordinating accessories. The belt 500 is a long reversible strip, having a pair of ends 500E and a length between the ends 500E with an obverse side 500V with a first fabric layer 40 having a first pattern and an inverse side 500N with a second fabric layer 40 having a second pattern, with a plurality of buttonholes 20 disposed horizontally along the length of the belt 500. To wear the belt 500, the user, having a waist, wraps the belt 500 around the waist, overlapping a first end 500E over the a second end 500E, matching the buttonholes 20 and connecting the ends 500E by inserting the studs into the matched buttonholes 20.

Figure 7:
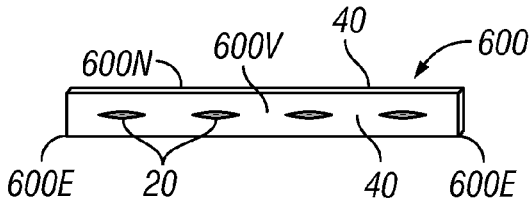
FIG. 7 is a diagrammatic perspective front view of a watch bracelet, an accessory constructed using the reversible seamless garment system.

Analogously, FIG. 7 shows a reversible bracelet 600, having a pair of ends 600E and a length between the ends 600E with an obverse side 600V with a first fabric layer 40 having a first pattern and an inverse side 600N with a second fabric layer 40 having a second pattern, with a plurality of buttonholes 20 disposed horizontally along the length of the bracelet 600. To wear the bracelet 500, the user, having a wrist, wraps the bracelet 600 around the wrist, overlapping a first end 600E over the a second end 600E, matching the buttonholes 20 and connecting the ends 600E by inserting the studs into the matched buttonholes 20. A watch can be attached to the bracelet 600.

Figure 14:
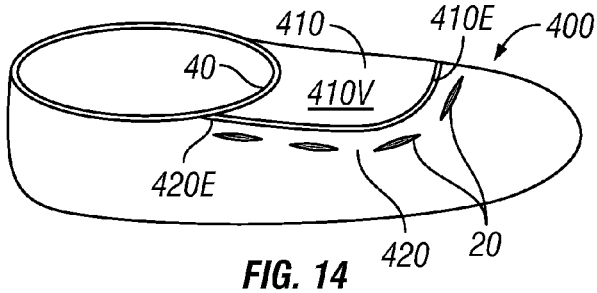
FIG. 14 is a diagrammatic perspective front view of a shoe, an accessory constructed using the reversible seamless garment system.

FIG. 14 shows a soft-soled shoe 400 with a reversible tongue 410. The tongue 410 has an ovoid edge 410E, an obverse side 410V with a first fabric layer 40 having a first pattern and an inverse side with a second fabric layer 40 having a second pattern, and a plurality of buttonholes 20 adjacent to the ovoid edge of the tongue. The shoe 400 has a vamp 420 having an ovoid edge 410E and a plurality of buttonholes 20 adjacent to the edge 420E of the vamp 420. The user choses which side of the tongue 410 to display and matches the buttonholes 20 on the edge 410E of the tongue with the buttonholes 20 on the edge 420E of the vamp 420, attaching the tongue 410 by inserting the studs into the matched buttonholes 20.

Figure 13:
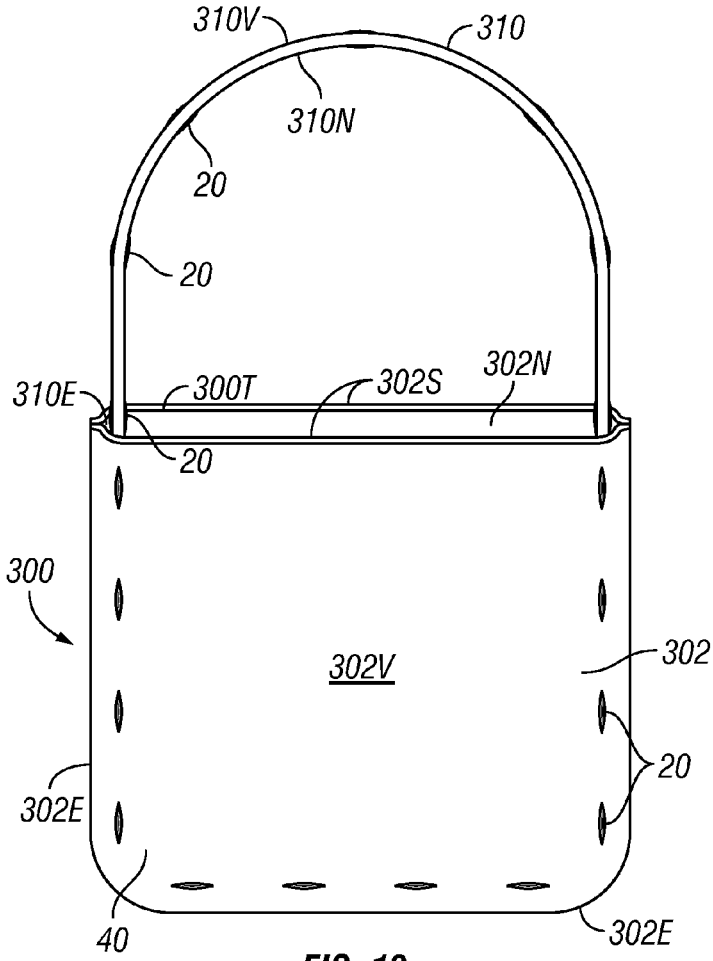
FIG. 13 is a diagrammatic perspective front view of a tote bag, an accessory constructed using the reversible seamless garment system.

FIG. 13 illustrates a tote bag 300, formed by attaching a pair of reversible essentially rectangular panels 302, each having a pair of surfaces, facing in opposite directions, creating an inside surface and an outside surface when joined together. The tote bag 300 is reversible, each panel 302 having a first fabric layer 40 with a first pattern on the obverse surface 302V and a second fabric layer 40 with a second pattern on the inverse surface 302N attached together so that the face sides of the fabric layers are facing in opposite directions. The user turns the tote bag inside out to switch to different patterns. The rectangular panels each have four edges, a pair of vertical edges 302E, a bottom horizontal edge 302B, and a top edge 302S. The tote bag is formed by joining three edges, the pair of vertical edges 302E and the bottom horizontal edge 302B of each panel 302, the three edges having a plurality of buttonholes disposed along the edges, leaving a fourth open edge 302S. The open edge 302S is at the top 300T of the tote bag 300. The user matches the buttonholes 20 of the panels 302, choosing whether to display the obverse surface 302V or inverse surface 302N of each panel 302, and attaches the panels 302 to each other by inserting the studs through the buttonholes 20. The tote bag has a strap 310 that is a long reversible strip, having a pair of ends 310E, a length between the pair of ends 310E, an obverse side 310V and an inverse side 310N, with a plurality of buttonholes disposed along the length of the strap 310. To attach the strap 310 to the tote bag 300, the user chooses whether to display the obverse side 310V of the strap or the inverse side 310N of the strap and the range of the strap desired. The user inserts the ends 310E of the strap between the pair of rectangular panels 302, one end 310 on each pair of vertical edges 302E, and matches the buttonholes on the ends of the strap 310E with the buttonholes on edges 302E of the panels 302. The user places the stud through the matched buttonholes on a first vertical edge 302E of the tote bag 300, through the selected buttonhole on the strap 310, and then on a second vertical edge 302E of the tote bag 300. The length of the strap 310 is determined by selecting the buttonhole on the strap to attach to the panels, the closer the buttonhole to the end 310E of the strap 310, the longer the strap.

In conclusion, herein is presented a reversible, seamless article of clothing and a system for constructing reversible seamless garments and accessories. The invention is illustrated by example in the drawing figures, and throughout the written description. It should be understood that numerous variations are possible, while adhering to the inventive concept. Such variations are contemplated as being a part of the present invention.

What is claimed is:

1. A system of constructing an article of clothing without sewn seams, comprising:

a plurality of reversible panels, each having a pair of outer surfaces, each panel formed by a pair of fabric layers having a face side, the fabric layers attached together so that the face sides of the fabric layers are on the outer surfaces of the panels and the panels each having a plurality of edges;

a plurality of two-headed button studs, having a shaft with a pair of ends and a pair of button heads attached orthogonally to the pair of ends, a button head on each end; and a plurality of buttonholes, each with a thru bore, and disposed along and adjacent to the edges of the reversible panels wherein a user arranges the panels to form an article of clothing by overlapping the edges of the panels, matching the buttonholes of the panels that the user wants to join to form the article of clothing, forming a plurality of buttonhole pairs and inserting the two-headed button studs into the thru bore, one in each buttonhole pair so that one button head is on the outer surface of each panel to attach the panels together to form the article of clothing without sewn seams wherein the article of clothing is a bodice formed from four reversible bodice panels having an obverse side and a mirror-image inverse side, a bottom diagonal edge, diagonally sloping downward toward the a first side, a top shoulder edge, a first side medial edge, extending upwardly about three-quarters of the length of the panel from the bottom diagonal edge, a neckline edge extending downwardly toward the first side, diagonally connecting the shoulder edge and the medial edge, a second side having a side edge extending upwardly about two-thirds of the length of the panel, a second side concave armhole with an edge connecting the second side edge and the shoulder edge, and a small oblique edge sloping upwardly from the bottom diagonal edge towards the medial edge at an obtuse angle, the panels forming the bodice by the user taking four bodice panels, a pair laid out on the obverse side and a pair laid out on the inverse side and attaching the edges of the observe sides to the edges of the inverse sides by overlapping the medial edges of the obverse sides with the medial edges of the inverse sides, and overlapping the side edges of the obverse sides with the side edges inverse sides and matching the buttonholes adjacent to the edges to form a plurality of buttonhole pairs, and inserting the two-headed button studs, one in each buttonhole pair to attach the panels together by a pair of joined medial edges and a pair of joined side edges to form the bodice without sewn seams.

2. The system of constructing an article of clothing without sewn seams as described in claim 1 wherein the article of clothing is an accessory selected from the group consisting of a belt, a bracelet, a soft-soled shoe and a tote bag.

3. The system of constructing an article of clothing without sewn seams as described in claim 1 wherein the article of clothing is a skirt formed from four reversible skirt panels having an obverse side and a mirror-image inverse side, having a first shorter side with a medial edge, a second longer side with a side edge, a bottom horizontal hem edge and a top waistline edge, diagonally sloping downward to the first shorter side, the panels forming the skirt by the user taking the four skirt panels, a pair laid out on the obverse side and a pair laid out on the inverse side and attaching the edges of the observe sides to the edges of the inverse sides by overlapping the medial edges of obverse sides with the medial edges of the inverse sides, and overlapping the side edges of the obverse sides with the side edges of the inverse sides and matching the buttonholes adjacent to the edges to form a plurality of buttonhole pairs, and inserting the two-headed button studs, one in each buttonhole pair to attach the panels together by a pair of joined medial edges and a pair of joined side edges to form the skirt without sewn seams.

4. The system of constructing an article of clothing without sewn seams as described in claim 3 wherein the article of clothing is a dress formed by attaching a bodice to a skirt by aligning the joined medial edges and joined side edges of the bodice with the joined medial edges and joined side edges of the skirt, to form a plurality of continuous vertical straight lines, overlapping the bottom diagonal edge of the bodice with the waist edge of the skirt, matching the buttonholes on the waist edge with the buttonholes on bottom diagonal edge of the bodice to form a plurality of buttonholes pairs, and inserting the two-headed button studs, one in each buttonhole pair to attach the bodice to the skirt to form the dress without sewn seams.

5. The system of constructing an article of clothing without sewn seams as described in claim 4 wherein a plurality of reversible trim elements are added to the article of clothing, the trim elements each having a pair of outer surfaces, each element formed by a pair of fabric layers having a face side, the fabric layers attached together so that the face sides of the fabric layers are on the outer surfaces of the elements, the elements each having a plurality of edges and a plurality of buttonholes, each buttonhole with a thru bore and disposed along and adjacent to the edges of the reversible elements wherein the user attaches the trim elements to the article of clothing by overlapping the edges of the trim elements with the edges of the panels where the user wishes to attach the trim elements, matching the buttonholes of the trim elements with buttonholes of the panels forming a plurality of buttonhole pairs, and inserting the two-headed button studs into the thru bore of the buttonholes, one in each buttonhole pair, so that one button head is on the outer surface of the panel and one on the opposing outer surface of the trim element to attach the trim elements to the panels without sewn seams.

6. The system of constructing an article of clothing without sewn seams as described in claim 5 wherein the trim elements are selected from the group consisting of sleeves, extenders, shoulder extenders, trim strips, neck, and pockets.

7. A method of constructing an article of clothing without sewn seams, having a plurality of reversible panels, each having a pair of outer surfaces, each panel formed by a pair of fabric layers having a face side, the fabric layers attached together so that the face sides of the fabric layers are on the outer surfaces of the panels, the panels each having a plurality of edges, a plurality of two-headed button studs, having a shaft with a pair of ends and a pair of button heads attached orthogonally to the pair of ends, a button head on each end, and a plurality of buttonholes, each with a thru bore, and disposed along and adjacent to the edges of the reversible panels, comprising:

overlapping the edges of the panels;

matching the buttonholes of the panels, forming pairs; and inserting the two-headed button studs into the thru bore, one in each buttonhole pair so that one button head is on the outer surface of each panel to attach the panels together to form the article of clothing without sewn seams wherein the article of clothing is a bodice formed from four reversible bodice panels having an obverse side and a mirror-image inverse side, a bottom diagonal edge, diagonally sloping downward toward the a first side, a top shoulder edge, a first side medial edge, extending upwardly about three-quarters of the length of the panel from the bottom diagonal edge, a neckline edge extending downwardly toward the first side, diagonally connecting the shoulder edge and the medial edge, a second side having a side edge extending upwardly about two-thirds of the length of the panel, a second side concave armhole with an edge connecting the second side edge and the shoulder edge, and a small oblique edge sloping upwardly from the bottom diagonal edge towards the medial edge at an obtuse angle, wherein the step of overlapping the edges of the panels is proceeded by the step of laying out two panels on the obverse side and a pair of panels in the inverse side in order to overlap the medial edges of the obverse sides with the medial edges of the inverse sides, the side edges of the obverse sides with the side edges inverse sides to overlap the medial edges.

8. The method of constructing an article of clothing without sewn seams as described in claim 7 wherein the article of clothing is a skirt formed from four reversible skirt panels having an obverse side and a mirror-image inverse side, having a first shorter side with a medial edge, a second longer side with a side edge, a bottom horizontal hem edge and a top waistline edge, diagonally sloping downward to the first shorter side.

9. The method of constructing an article of clothing without sewn seams as described in claim 8 wherein the article of clothing is a dress formed from the bodice and the skirt attaching a bodice to a skirt wherein the step of overlapping the bottom diagonal edge of the bodice with the waist edge of the skirt is preceded by the steps of aligning the joined medial edges and joined side edges of the bodice with the joined medial edges and joined side edges of the skirt to form a plurality of continuous vertical straight lines.

10. The method of constructing an article of clothing without sewn seams as described in claim 9 wherein the step of inserting the two-headed button studs into the thru bore, one in each buttonhole pair to attach the panels is followed by the steps of:

overlapping the edges of a plurality of reversible trim elements, the trim elements each having a pair of outer surfaces, each element formed by a pair of fabric layers having a face side, the fabric layers attached together so that the face sides of the fabric layers are on the outer surfaces of the elements, the elements each having a plurality of edges and a plurality of buttonholes, each buttonhole with a thru bore and disposed along and adjacent to the edges of the reversible elements with the edges of the panels where the user wishes to attach trim elements;

matching the buttonholes of the trim elements with buttonholes of the panels, forming a plurality of buttonholes sets; and inserting the two-headed button studs into the thru bore of the buttonholes, one in each buttonhole set, so that one button head is on the outer surface of the panel and one on the opposing outer surface of the trim element to attach the trim elements to the panels.

* * * * *